United States Patent [19]

Oda

[11] 4,427,289

[45] Jan. 24, 1984

[54] TONER RECOVERY APPARATUS OF ELECTROSTATIC COPYING MACHINE

[75] Inventor: Goro Oda, Tokyo, Japan

[73] Assignee: Tokyo Shibaura Denki Kabushiki Kaisha, Kawasaki, Japan

[21] Appl. No.: 426,230

[22] Filed: Sep. 28, 1982

Related U.S. Application Data

[63] Continuation of Ser. No. 164,937, Jul. 1, 1980, abandoned.

[30] Foreign Application Priority Data

Jul. 9, 1979 [JP] Japan ..... 54-85903
Jul. 9, 1979 [JP] Japan ..... 54-85904
Jan. 25, 1980 [JP] Japan ..... 55-6977

[51] Int. Cl.[3] ..... G03G 21/00

[52] U.S. Cl. ..... 355/15; 15/256.51; 118/652

[58] Field of Search ..... 355/15; 15/1.5, 256.51; 118/652; 198/631, 643; 222/371, 221, 415, DIG. 1

[56] References Cited

U.S. PATENT DOCUMENTS

| | | | |
|---|---|---|---|
| 2,303,957 | 12/1942 | Sayre | 222/415 X |
| 3,724,020 | 4/1973 | Till | 355/15 X |
| 3,752,576 | 8/1973 | Gerbasi | 355/15 |
| 3,974,944 | 8/1976 | Takeuchi | 222/DIG. 1 |
| 4,101,215 | 7/1978 | Fottner | 355/15 |
| 4,111,545 | 9/1978 | Meltzer | 355/15 |
| 4,174,172 | 11/1979 | Lane | 355/15 |
| 4,218,131 | 8/1980 | Ito et al. | 355/15 |
| 4,278,345 | 7/1981 | Davis et al. | 355/15 |
| 4,279,501 | 7/1981 | Kojima et al. | 355/15 |
| 4,297,021 | 10/1981 | Tani et al. | 355/15 X |
| 4,364,660 | 12/1982 | Oda | 355/15 |

*Primary Examiner*—Richard L. Moses
*Attorney, Agent, or Firm*—Cushman, Darby and Cushman

[57] ABSTRACT

A toner recovery apparatus for an electrostatic copying machine comprises a toner container for receiving the toner recovered from the surface of a photosensitive drum, a toner supplying device for supplying the toner to a developing device, and a toner transfer mechanism for transferring the toner from the toner container to the toner supplying device. The toner transfer mechanism includes a duct having a supporting surface extending between the toner container and the toner supplying device, a ladder chain stretched on the supporting surface of the duct to define a series of toner support spaces, each space being formed by each link of the ladder chain and the supporting surface of the guide member, and driving means for driving the ladder chain, to transfer the toner supported by the toner support space, to the toner supplying device.

19 Claims, 8 Drawing Figures

TONER RECOVERY APPARATUS OF ELECTROSTATIC COPYING MACHINE

This is a continuation of application Ser. No. 164,937 filed July 1, 1980, abandoned.

BACKGROUND OF THE INVENTION

This invention relates to toner recovery devices for electrostatic copying machines, particularly, to apparatus for supplying toner recovered from the surface of a photosensitive body to a developing device.

In an electrostatic copying machine, the toner remaining on the surface of a photosensitive drum after the transcription step is recovered in general and supplied again to a developing device in an effort to economize on toner. In many cases, an auger formed of an elastic material such as a plastic material or rubber is used as the means for transferring the recovered toner. For example, a container receiving the recovered toner houses a first auger which transfers the recovered toner toward one edge of the photosensitive drum. Naturally, the axis of the first auger is parallel with the axis of the drum. Also, a second auger housed in a duct further transfers the toner to a toner supplying device which supplies toner to the developing device. What should be noted is that the axis of the second auger is inevitably rendered perpendicular to the axis of the first auger by the relative locations of the toner container and the toner supplying device. It follows that, if the driving means of the photosensitive drum is utilized for driving the second auger for the purpose of cost reduction, it is necessary to provide a special transmission mechanism between the first and second augers, failing to achieve a satisfactory cost reduction.

In order to avoid using the transmission mechanism, it has been proposed to use a sharply bent single auger formed of an elastic material in place of the first and second augers mentioned above. In this case, however, the outer surface of the auger is brought into contact with the inner surface of the duct housing the auger, because of the elasticity of the auger. Naturally, to the toner held between the auger and the duct is compacted, resulting in formation of toner particles too large to be used again as the developing agent.

Incidentally, it is a matter of high importance to transfer the recovered toner from the toner container to the toner supplying device efficiently in order to enable the cleaning means, e.g., fur brush, to recover efficiently the toner remaining on the photosensitive drum.

SUMMARY OF THE INVENTION

An object of this invention is to provide a toner recovery apparatus for electrostatic copying machines which permits transferring efficiently and without fail the toner recovered from the surface of a photosensitive body from a toner container to a toner supplying device.

According to this invention, there is provided a toner recovery apparatus for an electrostatic copying machine provided with a photosensitive body, a cleaning means for recovering the toner from the surface of the photosensitive body, and a developing device serving to supply the toner to the surface of the photosensitive body. The toner recovery apparatus includes a toner container for receiving the toner recovered from the surface of the photosensitive body, a toner supplying device for supplying the toner to the developing device, and a toner transfer mechanism for transferring the toner from the toner container to the supplying device. The toner transfer mechanism includes a guide member having a supporting surface extending between the toner container and the toner supplying device, a ladder chain stretched on the supporting surface of the guide member to define a series of toner support spaces, each space being formed by each link of the ladder chain and the supporting surface of the guide member, and driving means for driving the ladder chain to transfer the toner supported by the toner support space, to the toner supplying device.

DETAILED DESCRIPTION OF PREFERRED EMBODIMENTS

Figure 1:
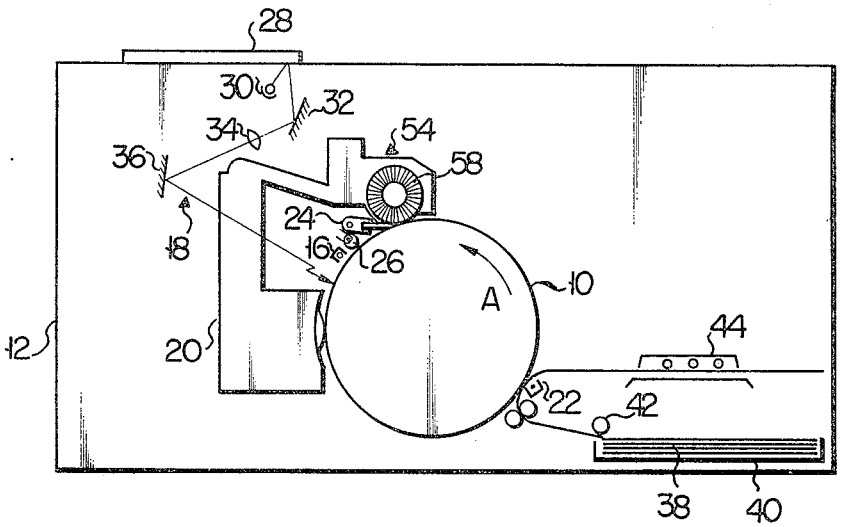
FIG. 1 is a cross sectional view schematically showing an electrostatic copying machine to which is applied an apparatus of this invention.

A toner recovery apparatus of this invention is used in an electrostatic copying machine as shown in, for example, FIG. 1. Naturally, the copying machine shown in FIG. 1 comprises a photosensitive drum 10 housed in a machine body 12. The drum 10 is rotatable in the direction denoted by an arrow A. As shown in the drawing, a charger 16, an exposure device 18, a developing device 20, a transcription device 22, a cleaning device 24 and a charge-erasing lamp 26 are provided along the outer surface of the drum 10. The exposure device 18 consists of a lamp 30 illuminating an original 28, a first mirror 32, a lens 34 and a second mirror 36. The light reflected from the original 28 is guided to the surface of the photosensitive drum 10 by the first and second mirrors. A paper cassette 40 housing sheets of copying paper 38 is disposed in a bottom portion of the machine body 12. The copying paper 38 is taken out of the cassette 40 sheet by sheet by a feeding roller 42 and fed into the clearance between the transcription device 22 and the surface of the drum 10. Finally, the picture image transcribed onto the copying paper is fixed by a fixing device 44.

Figure 2:
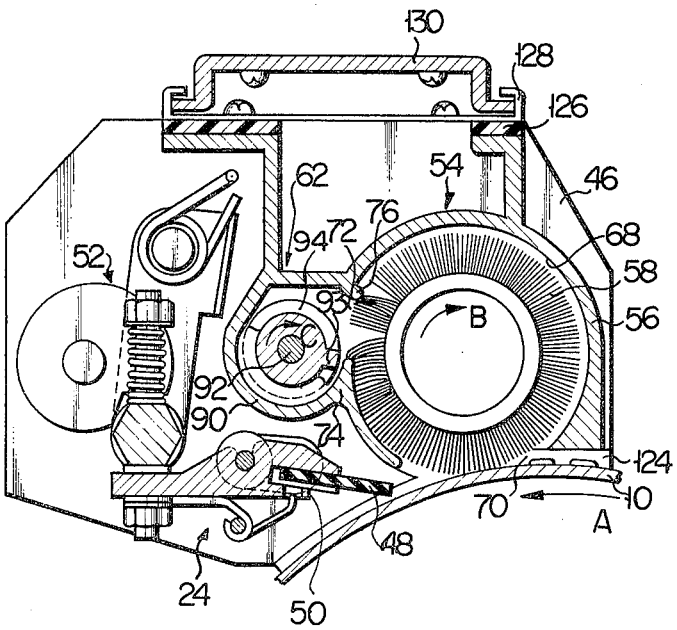
FIG. 2 is a cross sectional view showing the mechanism including a toner recovery apparatus according to one embodiment of this invention.

FIG. 2 shows that the cleaning device 24 formed as a single unit is mounted about the drum 10 rotatable in the counterclockwise direction (see arrow A). The cleaning device comprises a front frame 14 (see FIG. 4), a rear frame 46, a cleaning blade 48, a blade holder mechanism 50 and a drive mechanism 52 for driving the blade holder mechanism 50. The cleaning blade 48, which is brought into contact with the surface of the drum 10 during the cleaning operation, serves to remove the toner remaining on the surface of the drum 10. Also, the blade holder mechnism 50 serves to movably support the cleaning blade 48.

A toner recovery apparatus 54 serving to recover the toner removed from the drum surface is mounted adjacent to the cleaning device 24. The apparatus 54 comprises a hollow member 56 fixed to the front and rear frames 14, 46, a fur brush 58 serving to recover the toner removed from the drum surface by the cleaning blade 48, a fur brush driving mechanism 60 (see FIG. 3), a toner container 62 for receiving the recovered toner, a toner supplying device 64 (see FIG. 4) serving to supply the toner to the developing device 20, and a toner transfer mechanism 66 (see FIG. 4) serving to transfer the recovered toner from the toner container to the toner supplying device. The fur brush 58, which is disposed in an interior space 68 of the hollow member 56, is rotatably mounted to the front and rear frames 14, 46. The hollow member 56 is provided with a first opening 70 and a second opening 72. The tip of the cleaning blade 48 is located adjacent to the first opening 70 in the cleaning step.

The brushing portion of the fur brush 58 is formed of an elastic synthetic resin fibers of about 10 deniers, e.g., rayon fibers, which readily permits releasing the toner caught thereby, may also be used for forming the brushing portion of the fur brush. The outer circumferential surface of the fur brush 58, i.e., the free ends of the resin fibers, is allowed to contact lightly the tip of the cleaning blade 48 and the surface of the photosensitive drum 10 in the first opening 70 so as to prevent the recovered toner from being scattered outside the toner recovery apparatus 54. Incidentally, the fur brush 58 is rotatable in the clockwise direction as denoted by an arrow B in contrast to the drum 10 rotatable in the counterclockwise direction.

The hollow member 56 is provided with an inwardly inclined wall 74 and an inward projections 76 such that the second opening 72 is defined by the tip of the inclined wall 74 and the tip of the inward projection 76. To be more specific, the wall 74 is gently inclined such that the resin fibers of the fur brush 58 are allowed to abut against the wall 74 and the degree of bending of the fibers caused by the abutment is gradually increased toward the second opening 72. Naturally, the resin fibers abutting against the inward projection 76 are sharply bent during rotation of the fur brush 58.

Figure 3:
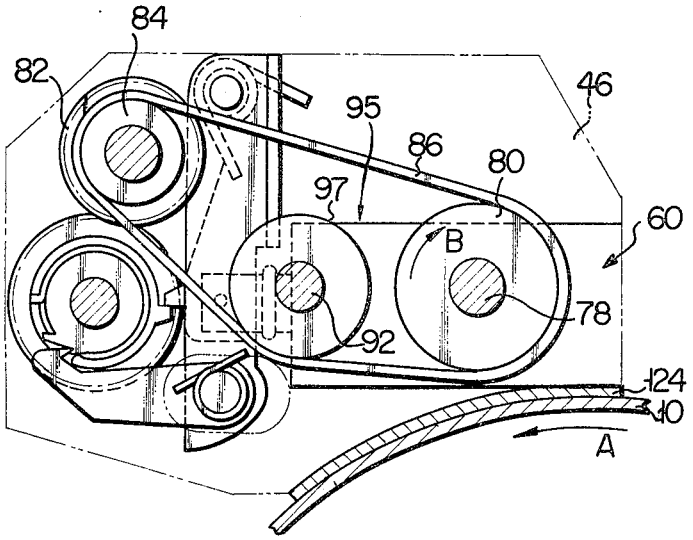
FIG. 3 is a cross sectional view showing the driving mechanism of the apparatus shown in FIG. 2.

As shown in FIG. 3, the fur brush driving mechanism 60 comprises a shaft 78, a first ladder wheel 80, a second ladder wheel 84 and a ladder chain 86 stretched between the first and second ladder wheels 80 and 84.

The shaft 78, to which is mounted the fur brush 58, is rotatably supported by and extends through, the rear frame 46. Incidentally, the fur brush 58 is located between the front and rear frames 14 and 46. The first ladder wheel 80 is coaxially fixed to the end portion of the shaft 78 located behind the rear frame 46. Further, the second ladder wheel 84 is engaged with a gear 82 driven by a driving source (not shown) included in the blade holder driving mechanism 52. The diameters of the first and second ladder wheels are determined in a manner to enable the peripheral speed of the fur brush 58, i.e., the speed of the free end of the resin fiber, to be equal to the peripheral speed of the surface of the drum 10 in order to prevent the recovered toner from becoming fumy in and around the first opening 70.

Figure 4:
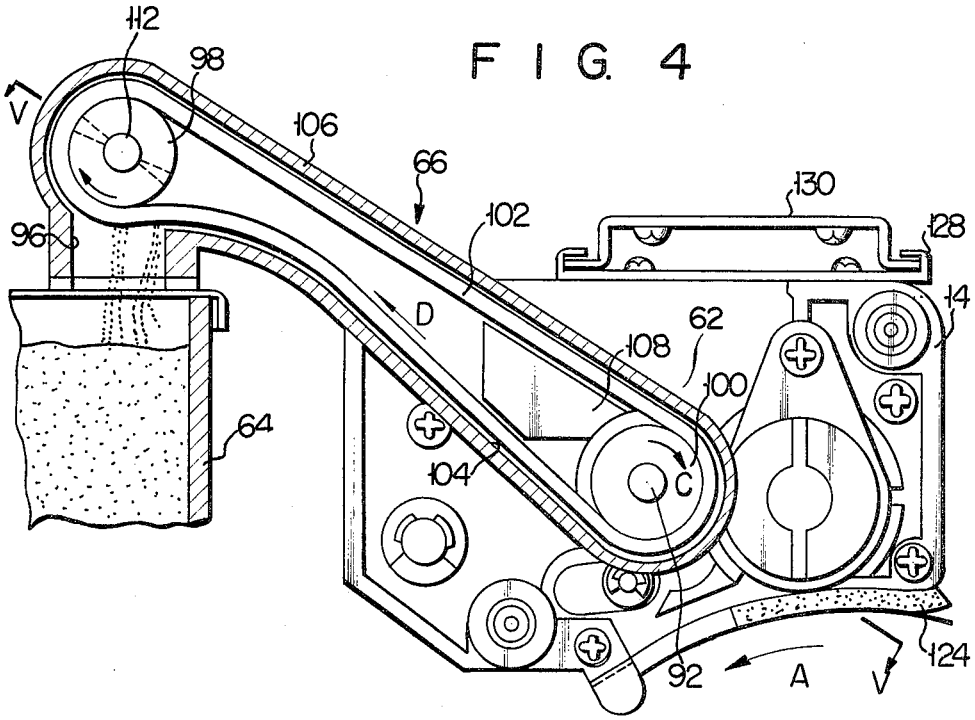
FIG. 4 is a cross sectional view showing the toner transfer mechanism included in the apparatus shown in FIG. 2.
Figure 5:
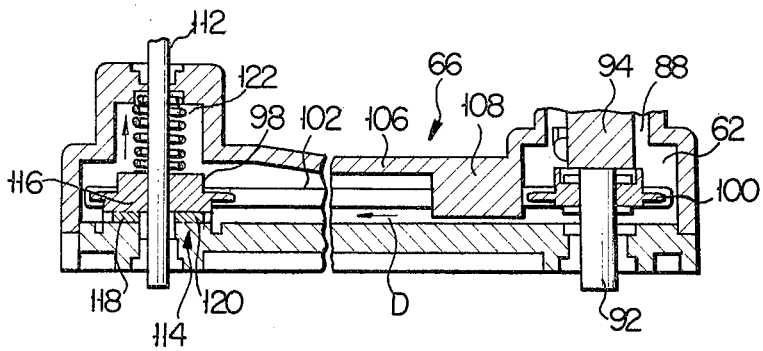
FIG. 5 is a cross sectional view along the line V—V of FIG. 4.

As seen from FIGS. 2, 4 and 5, the toner container 62 serving to receive the toner recovered by the fur brush 58 comprises a casing 90, an auger 94 provided with a spiral vane 93, and an auger driving mechanism 95. The casing 90 which communicates with the second opening 72, defines a first toner passageway, and is provided with a toner outlet port 88 located near one end (or, the front end) of the photosensitive drum 10. The auger 94 is provided within the casing 90, fixed to a rotary shaft 92 parallel with the rotary shaft 78 (see FIG. 3) of the fur brush 58, and serves to transfer the toner housed in the casing 90 to the toner outlet port 88. The auger driving mechanism 95 comprises a third ladder wheel 97 fixed to the end portion of the rotary shaft 92 located behind the rear frame 46. As seen from FIG. 3, the third ladder wheel 97 is engaged with the ladder chain 86 stretched between the first and second ladder wheels 80 and 84.

The toner housed in the toner container 62 is transferred to a toner supplying device 64 by a toner transfer mechanism 66. As seen from FIGS. 4 and 5, the toner transfer mechanism 66 comprises a fourth ladder wheel 98, fifth ladder wheel 100, a ladder chain 102 stretched between the fourth and fifth ladder wheels 98 and 100, and a duct 106 forming a second toner passageway. The fourth ladder wheel 98 is located outside the front frame 14 and above a toner inlet port 96 of the toner supplying device 64. The fifth ladder wheel 100 is located adjacent to the toner outlet port 88 of the casing 90 and is fixed to the rotary shaft 92 of the auger 94. Further, the duct 106 acts as a guide member provided with a supporting surface 104 extending between the toner inlet port 96 of the toner supplying device 94 and the toner container 62. Incidentally, the fifth ladder wheel 100 is driven by the driving means of the auger 94.

The duct 106 is rectangular in cross section and the inner surface of the bottom wall of the duct acts as the supporting surface 104. As apparent from FIG. 4, the supporting surface 104 is inclined because of the relative locations of the toner container 62 and the toner supplying device 64. It is important to set the maximum inclination of the supporting surface 104 at 40° relative to the horizontal in view of the dead angle of the toner. Further, a block 108 serving to prevent the toner from dropping toward the toner outlet port 88 is provided within the duct 106. The block 108 is fixed to the inner surface of the side wall of the duct 106.

Figure 6:
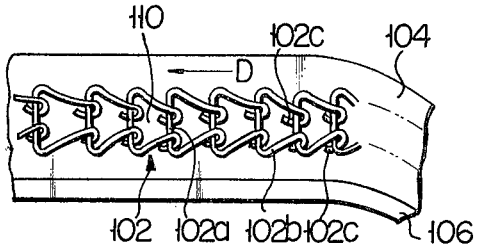
FIG. 6 is an oblique view showing the ladder chain included in the apparatus shown in FIG. 2.
Figure 7:
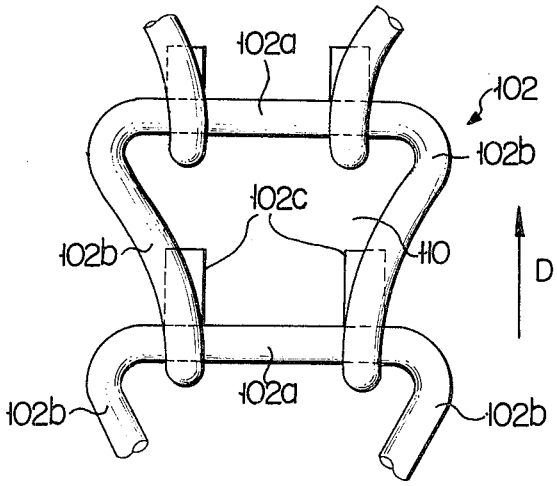
FIG. 7 is a plan view showing the construction of the link of the ladder chain of FIG. 6 in a magnified fashion.

The ladder chain 102 performs both torque transmitting function and toner transfer function. Specifically, the torque of the fifth ladder wheel 100 is transmitted to the fourth ladder wheel 98 by the ladder chain 102. On the other hand, FIGS. 6 and 7 are intended to clarify the toner transfer function of the ladder chain 102. As clearly seen from the drawings, the ladder chain 102 consists of a number of rigid wires which are bent and joined to each other in a manner to form a series of links. For example, a piano string or stainless steel wire having a diameter of about 1.5 mm is suitable for forming the ladder chain 102. As shown in FIG. 7, the rigid wire is bent in a manner to provide a straight portion **102*a*, a pair of inwardly bent portions 102*b* and a pair of folded positions 102*c* extending in a direction perpendicular to the straight portion 102*a*. The folded portions 102*c* are engaged with the straight portion of the adjacent wire, with the result that a link is formed by two adjacent straight portions 102*a* and a pair of inwardly bent portions 102*b*. In this fashion, a number of bent rigid wires are joined to each other so as to form the ladder chain 102 of an endless belt structure. Incidentally, the ladder chain 102 is run in the direction denoted by an arrow D, namely, the straight portion 102***a* of the wire is positioned ahead of the folded portions 102*c* with respect to the running direction of the chain 102. It should be noted that a toner support space 110 is defined by each link of the ladder chain 102 and the supporting surface 104, i.e., the inner surface of the bottom wall of the duct 106. It follows that the ladder chain 102 performs the toner transfer function as well.

The fourth ladder wheel 98, which is mounted to a shaft 112, is movable in the axial direction of the shaft 112 and allowed to vibrate in said direction during its rotation. Specifically, a vibration mechanism 114 is defined by a projection 118 of the wheel 98, an irregular portion 102 facing the projection 118 and formed in the side wall of the duct 106, and a spring 122 wound around the shaft 112. The projection 118 extends from a boss portion 116 of the wheel 98 toward the irregular portion 120 in the axial direction of the shaft 112. The irregular portion 120 consists of a plurality of gentle protuberances projecting toward the wheel 98. Further, the bias force of the spring 122 permits the tip of the projection 118 to abut against the irregular portion 120. It follows that the tip of the projection 118 is allowed to slide along the irregular portion 120 in accordance with rotation of the wheel 98, resulting in vibration of the fourth ladder wheel 98 in the axial direction of the shaft 112. Naturally, the protuberances forming the irregular portion 120 should be made gentle for facilitating the sliding motion of the tip of the projection 118.

Incidentally, each of reference numerals 124 and 126 represents a seal member for preventing the toner from being scattered to the outside of the cleaning device 24. Also, a reference numeral 128 denotes a guide which is engaged with a rail 130 mounted to the body of the copying machine.

In operating the electrostatic copying machine described above, a main switch, not shown, of the copying machine is turned on for actuating the driving source of the machine. Naturally, the entire machine including the toner recovery apparatus 54, developing device 20, photosensitive drum 10, etc. connected to the driving source is rendered ready for operation. Then, a print switch (not shown) is turned on for initiation of the copying function.

Upon initiation of the copying function, the cleaning blade 48 is brought into direct contact with the surface of the photosensitive drum 10. Thus, the toner remaining on the drum surface after the transcription steps is removed by the cleaning blade 48. The removed toner is held by the fur brush 58 rotating in the clockwise direction. Since the peripheral speed of the free ends of the resin fibers of the fur brush 58 is equal to the peripheral speed of the drum surface, the toner is held by the fur brush 58 without fail and carried along the inner surface of the inwardly inclined wall 74 of the hollow member 56 to the second opening 72. As described previously, the resin fibers of the fur brush 58 are elastic and, thus, bent such that the degree of bending gradually increases in accordance with movement of the fibers toward the second opening 72. Naturally, the resin fibers thus bent are brought back to the original positions in reaching the second opening 72, thereby releasing the toner held therebetween. Then, the resin fibers are allowed to abut against the inward projection 76 to the hollow member 56. As a result, the residual toner attached to the fur brush 58 is completely released into the toner container 62 through the second opening 72, rendering the fur brush 58 ready for the next toner recovery function.

The toner released into the toner container 62 is transferred to the toner outlet port 88 formed on the side of the front frame 14 by the auger 94 rotating in the clockwise direction as denoted by an arrow C. The toner is further transferred from the toner outlet port 88 to the inlet port 96 of the toner supplying device 64 by the toner transfer mechanism 66 shown in, particularly, FIGS. 4 and 5. To reiterate, the fifth ladder wheel 100 is rotatable together with the auger 94 and the ladder chain 102 is stretched between the fourth ladder wheel 98 positioned above the inlet port 96 of the toner supplying device 64 and the fifth ladder wheel 100. In addition, the toner support space 110 is defined by each link of the ladder chain 102 and the supporting surface 104, i.e., the inner surface of the bottom wall of the duct 106. It follows that the toner transferred to the toner outlet port 88 is disposed on the toner support space 110 and carried in the direction of an arrow D toward the inlet port 96 of the toner supplying device 64 in accordance with rotation of the auger 94.

As described previously, the fourth ladder wheel 98 is provided with the vibration mechanism 114. Thus, the wheel 98 is vibrated in the axial direction of the shaft 112 during rotation of the wheel 98. Naturally, the vibration of the wheel 98 is transmitted to the ladder chain 102. Thus, the toner disposed on the toner support space 110 and carried toward the wheel 98 is completely dropped into the toner supplying device 64 through the inlet port 96. It should be noted that the vibration of the fourth ladder wheel 98 is transmitted to the fifth ladder wheel 100, too, by the ladder chain 102. Naturally, the toner accumulated in the toner outlet port 88 is also vibrated and, thus, prevented from forming large toner particles. It should also be noted that the block 108 serves to prevent the toner falling from the toner support space 110 because of the vibration of the ladder chain 102 from reaching the toner outlet port 88.

As described above in detail, the ladder chain 102 is included in the toner transfer mechanism 66 utilized in this embodiment for transferring the recovered toner from the toner container 62 to the toner supplying device 64. Thus, it is of no difficulty to make the toner transfer direction within the transfer mechanism 66 perpendicular to that of the auger 94 extending in parallel with the axis of the photosensitive drum 10. In addition, the toner transfer mechanism 66 can be easily driven and can be made smaller than in the prior art.

Also, the fourth ladder wheel 98 is vibrated by the vibration mechanism 114 during rotation of the wheel 98, rendering it possible to release substantially completely the toner attached to the ladder chain 102 into the toner supplying device 64. Further, the vibration of the fourth ladder wheel 98 is transmitted to the fifth ladder wheel 100 via the ladder chain 102, with the result that the toner within the toner outlet port 88 is also vibrated and, thus, prevented from forming large toner particles. In other words, the recovered toner can be used again satisfactorily as the developing agent.

An additional merit to be noted is that the ladder chain 102 is formed of fine wires. Thus, the toner, which has not been dropped into the toner supplying device 64, is not caught by the fourth ladder wheel 98, leading to an enhanced toner transfer efficiency.

Figure 8:
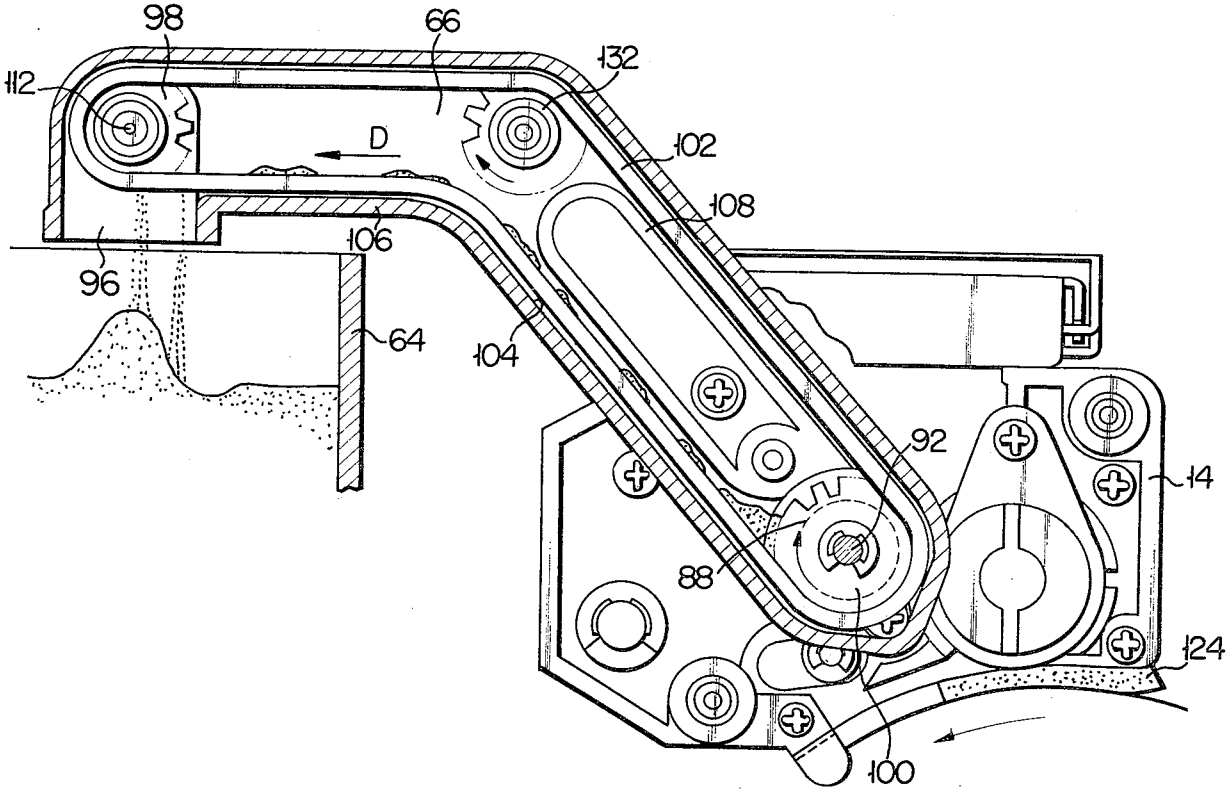
FIG. 8 is a cross sectional view schematically showing the toner transfer mechanism of an apparatus according to another embodiment of this invention.

FIG. 8 shows another embodiment of this invention. The embodiment of FIG. 8 is the same as the embodiment described previously except that the duct 106 is bent about the center thereof and a sixth ladder wheel 132 is provided at the bent portion of the duct. As seen from the drawing, the sixth ladder wheel 132 is engaged with that portion alone of the ladder chain 102 which runs along the upper wall of the duct 106. Since the fifth ladder wheel 100 rotating in the clockwise direction serves to drive the ladder chain 102, the ladder chain 102 is somewhat loosened at the portion running along the supporting surface 104. What should be noted is that the use of the sixth ladder wheel 132 renders it possible to bend the duct 106, producing an allowance in design. Further, the toner disposed between the supporting surface 104 and the underside of the ladder chain 102 is prevented from forming large particles because the ladder chain is somewhat loosened in that portion.

In the embodiments described above, the toner supplying device 64 is provided separately from the developing device 20. But, it is also possible to have the toner supplying device 64 replaced by a toner housing section of the developing device 20. To be brief, any type of vessel or the like may be used in place of the toner supplying device 64 as far as the vessel mentioned is capable of temporarily storing the recovered toner.

In the embodiments described above, the end portions of each of the rigid wires forming the ladder chain 102 are folded such that the folded portions 102*c* of the wire are disposed below the straight portion 102*a* of the succeeding wire. But, it is of course possible to fold the rigid wires such that the folded portions 102*c* are disposed above the straight portion 102*a*. Further, the fourth ladder wheel 98 is provided with the vibration mechanism 114 in the embodiments described above. But, it is of course possible to have the fifth ladder wheel 100 provided with an additional vibration mechanism of the similar construction.

What is claimed is:

1. A toner recovery apparatus for an electrostatic copying machine provided with a drum-shaped photosensitive body having a photosensitive layer laid on the outer circumference thereof and rotated in one direction and a developing device, said toner recovery apparatus comprising:

a cylindrical fur brush disposed substantially above said photosensitive body and forward, with respect to said one direction, of a vertical line passing through the center of said photosensitive body, said fur brush including a large number of elastic fibers on the outer circumference thereof;

first driving means for rotating said fur brush in a direction opposite to said one direction, free ends of said elastic fibers of said fur brush lightly contacting the surface of said photosensitive body during rotation of said fur bruch to enable said free ends to hold toner remaining on the surface of said photosensitive layer therebetween, thereby removing said remaining toner from said photosentitive body;

a cleaning blade having a tip and being disposed substantially above said photosensitive body downstream of said fur brush and upstream of said developing device with respect to said one direction, said blade tip being capable of contact with said photosensitive layer such that, when in contact with said photosensitive layer, said blade tip scrapes off said toner which has not been removed by said fur brush, thereby cleaning the photosensitive layer; and second driving means for bringing said tip of said cleaning blade into contact with said photosensitive layer and said free ends of said fibers of said fur brush when said photosensitive body is rotated and for moving said cleaning, blade away from said photosensitive layer when rotation of said photosensitive body is stopped, thereby enabling said toner removed from said photosensitive layer by said cleaning blade to be held between said fibers of said fur brush to be recovered.

2. The apparatus according to claim 1 further comprising:

a toner container for receiving said toner recovered from the surface of said photosensitive body;

a toner supplying device for supplying said toner to a developing device; and a toner transfer mechanism for transferring the toner from said toner container to said toner supplying device, said toner transfer mechanism including a guide member having a supporting surface extending between said toner container and said toner supplying device, a ladder chain stretched on the supporting surface of said guide member to define a series of toner support spaces, each space being formed by each link of the ladder chain and said supporting surface of the guide member, and driving means for driving said ladder chain, to transfer said toner supported by said toner support space, to said toner supplying device.

3. The apparatus according to claim 2, wherein said driving means comprises a pair of rotatable ladder wheels between which said ladder chain is stretched.

4. The apparatus according to claim 3, wherein said toner supplying device is disposed above said toner container.

5. The apparatus according to claim 4, wherein one of said ladder wheels is disposed directly above said toner supplying device and another of said ladder wheels within the toner container, thereby allowing said supporting surface to be inclined with respect to the horizontal.

6. The apparatus according to claim 5, wherein said supporting surface has an inclination smaller than the dead angle of the toner.

7. The apparatus according to claim 5, wherein said ladder wheel disposed within said toner container is rotated in a direction permitting said ladder chain to be somewhat loosened at the portion where said toner support space is formed.

8. The apparatus according to claim 7, wherein said driving means further comprises at least one additional ladder wheel to guide the tensioned portion of said ladder chain.

9. The apparatus according to claim 7, wherein said guide member has a conduit being rectangular in cross section and a block to prevent said toner falling from said toner support space from reaching said toner container.

10. The apparatus according to claim 9, wherein said block is fixed to the inner surface of said side wall of said guide member.

11. The apparatus according to claim 2, wherein said driving means is provided with a vibration mechanism for vibrating said ladder chain.

12. The apparatus according to claim 11, wherein said vibration mechanism vibrates at least one of said pair of rotatable ladder wheels.

13. The apparatus according to claim 12, wherein said ladder wheel disposed above said toner supplying device is provided with said vibration mechanism.

14. The apparatus according to claim 13, wherein said ladder wheel disposed above said toner supplying device is movable along the axis about which said ladder wheel is rotated, and the vibration mechanism comprises an irregular portion formed on the side wall of said guide member, and a projection extending from said ladder wheel toward said irregular portion of said side wall, the tip of said projection abutting against said irregular portion.

15. The apparatus according to claim 14, wherein said vibration mechanism further comprises means for urging said projection toward the irregular portion.

16. The apparatus according to claim 12, wherein said ladder wheel disposed within said toner container is provided with said vibration mechanism.

17. The apparatus according to claim 16, wherein said ladder wheel disposed within said toner container is movable along the axis about which said ladder wheel is rotated, and said vibration mechanism comprises an irregular portion formed on a side wall of said guide member, and a projection extending from the ladder wheel toward the irregular portion of the side wall, the tip of said projection abutting against said irregular portion.

18. The apparatus according to claim 17, wherein said vibration mechanism further comprises means for urging said projection toward said irregular portion.

19. An electrostatic copying machine comprising a drum-shaped photosensitive body having a photosensitive layer laid on the outer circumference thereof and rotated in one direction, means for applying an electrostatic latent image to said photosensitive layer, a developing device for developing said electrostatic latent image and a toner recovery apparatus, said toner recovery apparatus comprising:

a cylindrical fur brush disposed substantially above said photosensitive body and forward, with respect to said one direction, of a vertical line passing through the center of said photosensitive body, said fur brush including a large number of elastic fibers on the outer circumference thereof;

a cleaning blade having a tip and being disposed substantially above said photosensitive body, upstream of said developing device and downstream of said fur brush with respect to said one direction, said blade tip being capable of contact with said photosensitive layer such that, when said blade tip; is in contact with said photosensitive layer, said blade tip scrapes off said toner thereby cleaning the photosensitive layer;

first driving means for rotating said fur brush in a direction opposite to said one direction; and second driving means for bringing said tip of said cleaning blade into contact with said photosensitive layer and said free ends of said fibers of said fur brush when said photosensitive body is rotated and for moving said cleaning blade away from said photosensitive layer when rotation of said photosensitive body is stopped, thereby enabling said toner removed from said photosensitive layer by said cleaning blade to be held between said fibers of said fur brush to be recovered.

* * * * *